United States Patent [19]

Ravi

[11] Patent Number: 4,975,622

[45] Date of Patent: Dec. 4, 1990

[54] HPS DISCHARGE LAMP WITH SIMPLIFIED STARTING AID STRUCTURE

[75] Inventor: Jagannathan Ravi, Elmira, N.Y.

[73] Assignee: North American Philips Corp., New York, N.Y.

[21] Appl. No.: 292,594

[22] Filed: Dec. 30, 1988

[51] Int. Cl.[5] ..... H01J 17/34; H01J 17/02

[52] U.S. Cl. ..... 315/56; 315/73; 315/47; 313/574; 313/631

[58] Field of Search ..... 313/631, 333, 632, 634, 313/624, 573, 574, 570, 594, 47; 315/73, 74, 75, 56, 46, 47, 59, 60

[56] References Cited

U.S. PATENT DOCUMENTS

| | | | |
|---|---|---|---|
| 3,872,340 | 3/1975 | Collins | 313/198 |
| 3,900,753 | 8/1975 | Richardson | 313/198 |
| 4,412,152 | 10/1983 | Barakitis et al. | 315/73 |
| 4,498,030 | 2/1985 | Govaerts et al. | 315/60 |

*Primary Examiner*—Eugene R. Laroche
*Assistant Examiner*—Ali Neyzari
*Attorney, Agent, or Firm*—Emmanuel J. Lobato

[57] ABSTRACT

An HPS sodium vapor discharge lamp having a starting aid consisting essentially of a metallic band disposed circumscribing one end of the lamp discharge vessel, and means for applying a voltage to the metallic bond for inducing ionization throughout the volume of the discharge vessel to facilitate lamp starting. The metallic band may define a heat shield for inhibiting thermal radiation from one end of the discharge vessel.

14 Claims, 1 Drawing Sheet

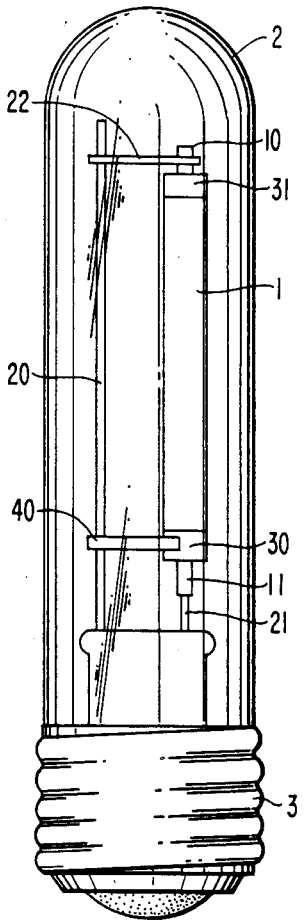
2
22
10
31
1
20
40
30
11
21
3

HPS DISCHARGE LAMP WITH SIMPLIFIED STARTING AID STRUCTURE

BACKGROUND OF THE INVENTION

The present invention relates to starting aids for high pressure sodium vapor discharge lamps, and more particularly, such a starting aid having simplified structure.

High pressure sodium (HPS) discharge lamps comprise a discharge vessel containing a pair of discharge electrodes, and a sodium amalgam which is partially vaporized and ionized during lamp operation to produce light. Some types of HPS lamps also have an inert buffer gas within the discharge vessel for influencing the internal pressure and temperature of the atmosphere within the discharge vessel during operation.

The inert buffer gas makes the lamp difficult to start before the discharge electrodes are heated if the buffer gas fill pressure is above a certain value range, typically 50 torr. In order to facilitate starting it is conventional to provide a starting aid which promotes ionization within the buffer gas, prior to the onset of arc discharge, in order to lower the breakdown voltage within the discharge vessel.

These starting aids have various constructions such as a length of wire wrapped around the outside surface of the discharge vessel as shown, for example, in U.S. Pat. No. 4,037,129, and British Patent Nos. 1,493,270, 1,340,551 and 1,569,305. Another type of starting aid is comprised of a rod-like conductor extending along a substantial portion of the length of the discharge vessel, as shown in U.S. Pat. Nos. 4,277,725, 4,328,445, 4,498,030 and 4,521,716. Still another construction, comprising a bimetallic element which contacts the discharge vessel when the lamp is cold and springs away when the lamp is heated is disclosed in U.S. Pat. No. 3,872,340.

All of the starting aids discussed above comprise several structural elements which must be assembled as part of the lamp during lamp fabrication. This makes the lamp more costly. In addition, in some designs parts of the starting aids are made of niobium, and entail niobium welds. Niobium is a difficult metal to weld, and these welds are susceptible to failure from environmental causes such as vibration. If the weld fails, the starting aid may become ineffective and the lamp will be impossible to start.

It is accordingly an object of the invention to provide an effective starting aid for HPS discharge lamps which has a simplified structure and fewer parts in order to improve reliability and decrease cost.

SUMMARY OF THE INVENTION

According to the invention a high pressure sodium vapor discharge lamp comprises the conventional structure of an elongate discharge vessel containing an inert buffer gas and a sodium amalgam. The improved starting aid according to the invention consists essentially of a metallic band proximate one end of the discharge vessel and disposed on the discharge vessel circumferentially thereof. The surface of the discharge vessel is free of auxiliary conductors such as coils of wire or rods along its length, and means is provided for applying a voltage to the metallic band for inducing ionization throughout the volume of the discharge vessel to facilitate lamp starting.

In a preferred embodiment of the invention the metallic band defines a heat shield for inhibiting thermal radiation from the one end of the discharge vessel at which it is mounted.

In another preferred embodiment the means for applying a voltage to the metallic band is comprised of a bimetallic switch responsive to the temperature of the discharge vessel for removing the voltage applied to the metallic band after the temperature of the discharge vessel has reached a certain predetermined value.

BRIEF DESCRIPTION OF THE DRAWING

The sole FIGURE of the drawing illustrates a high pressure sodium vapor discharge lamp having a starting aid according to the invention.

DETAILED DESCRIPTION OF THE INVENTION

The lamp shown in the drawing is a HPS discharge lamp comprised of an elongate discharge vessel 1 disposed within an outer envelope 2 and having a lamp base 3 at one end of the outer envelope 2. The discharge vessel has a pair of conductive feed throughs 10, 11 for applying a voltage to a pair of discharge electrodes within the discharge vessel.

A quantity of a sodium-mercury amalgam is contained within the discharge vessel 1, together with an inert buffer gas such as xenon. In order to initiate discharge breakdown through the fill material within the discharge vessel, within the voltage limits of commercial lamp starters, means must be provided for creating an initial ionization within the volume of the discharge vessel 1.

The starting and operating voltage applied to the feed throughs 10 and 11 is applied through a conductive path defined by the conductive support rods 20 and 21, and the conductive support 22. This structure is conventional.

Metallic bands 30, 31 which typically are niobium, are each disposed at a respective end of the discharge vessel 1 for inhibiting thermal losses at these ends. The discharge vessel ends are the lowest temperature regions of the discharge vessel. The heat shields 30, 31 result in elevated end temperatures relative to a lamp without a heat shield and consequently a more uniform temperature distribution, and elevated internal operating pressures in saturated HPS lamps.

According to the invention, at least one of the heat shields 30 is used as a starting aid. A conductive element 40 bridges the support rod 20 and the heat shield 30 so that the potential difference applied to the feed throughs 10 and 11 is also developed between the heat shield 30 and the feed through 11 and its associated internal discharge electrode. This potential difference results in substantial ionization of the inert buffer gas, before discharge breakdown occurs across the length of the discharge vessel 1, and facilitates the occurrence of the discharge breakdown.

In a preferred embodiment of the invention the conductive strip 40 is a bimetallic strip welded to the support rod 20 and biased against the heat shield 30 when the lamp is cool. When the lamp reaches its operating temperature, the bimetallic strip 40 is heated and flexes away from the heat shield 30 to electrically disconnect it from the support rod 20.

EXAMPLE

The effectiveness of the starting aid according to the invention was established by comparing the starting of two conventional 250 watt high pressure sodium lamps; one having a conventional linear starting aid extending along the length of the discharge vessel and the second having the starting aid according to the invention. The starting aid according to the invention did not include any auxiliary conductors other than the conductive metal band around an end of the discharge vessel. Both discharge vessels were of the unsaturated type and contained xenon at a fill pressure of 100 torr.

The lamps were started on commercial 250 watt ballasts having a 240 volt primary. The lamp having the starting aid according to the invention started when the primary voltage was within the range of 240 volts to 210 volts but did not start at a primary voltage of 200 volts. The lamp having the linear conventional starting aid did start over the entire 240 volt to 200 volt primary voltage range.

The starting aid according to the invention is almost as effective as the conventional linear starting aid, and will start the lamp when the ballast primary voltage decreases more than ten percent of its rated value.

Unsaturated HPS lamps having a xenon fill pressure of 130 torr have also been made with the starting aid according to the invention and have been found to start well.

The reason for the effectiveness of the invention, notwithstanding the absence of auxiliary conductors along the length of the discharge vessel is believed to arise from the following. The potential difference between the conductive metal band of the starting aid and the proximate internal electrode of the discharge vessel is effective to induce a substantial amount of ionization throughout the volume of the discharge vessel, and this ionization is just what is needed in order to facilitate lamp starting. The linear starting aid comprised of a conductor along the length of the discharge vessel induces ionization, but because of its narrow wire-like geometry the ionization is principally only in its vicinity. The ions and electrons thus produced are in the vicinity of the discharge vessel wall and their numbers are diminished by recombination with the discharge vessel wall. Consequently, volume ionization is not as effectively produced even though the linear starting aid is substantially the length of the discharge vessel.

This belief is supported by the phenomena observed when the respective starting aids are coupled to a high voltage Tesla coil. When the metal band 30 of the invention is coupled to a Tesla coil a visible glow is observed throughout the discharge vessel volume, indicating effective volume ionization of the inert buffer gas prior to lamp starting. On the other hand, when the linear conductor of the conventional starting aid is coupled to the Tesla coil the glow is visible within the discharge vessel along the length of the linear conductor but only in the region close to it and not throughout the entire volume of the discharge vessel. Thus, the buffer gas ionization is localized, probably due to recombination at the discharge vessel wall.

It will be seen that the structure of the starting aid according to the invention is simple and has substantially fewer parts and manufacturing steps than the prior art starting aids. In the preferred embodiment the metallic conductive band is also a heat shield; however, it is within the scope of the invention to include a metallic conductive band that is not positioned at an extreme end of the discharge vessel where it will perform the heat shield function, but which is instead positioned proximate one of the discharge vessel ends to further facilitate volume ionization throughout the discharge vessel. Moreover, the means for applying a voltage to the conductive metal band need not be the bimetallic switch structure disclosed in the preferred embodiment, but could be a permanently fixed conductor, a diode biasing circuit or some other circuit. Accordingly, the preferred embodiment described in detail should be taken as exemplary, and not limiting, and the invention is defined by the following claims.

What is claimed is:

1. In a high pressure sodium vapor discharge lamp of the type having an elongate discharge vessel, an inert buffer gas within said discharge vessel, and a sodium amalgam within said discharge vessel, the improvement consisting essentially of:

a metallic band disposed circumscribing one end of said discharge vessel and defining a heat shield for inhibiting thermal radiation from said one end of said discharge vessel; and means for applying a voltage to said metallic heat shield for inducing ionization throughout the volume of said discharge vessel to facilitate lamp starting.

2. In a high pressure sodium vapor discharge lamp according to claim 1, wherein said means for applying a voltage is comprised of a bimetallic switch responsive to the temperature of said discharge vessel for removing the voltage applied to said heat shield after the temperature of said discharge vessel has reached a certain predetermined temperature.

3. In a high pressure sodium vapor discharge lamp according to claim 2, where said inert buffer gas within said discharge vessel comprises xenon at a fill pressure of about 100 to about 1000 torr.

4. In a high pressure sodium vapor discharge lamp according to claim 3, wherein said inert buffer gas within said discharge vessel comprises xenon at a fill pressure of about 100 to about 130 torr.

5. In a high pressure sodium vapor discharge lamp according to claim I, where said inert buffer ga within said discharge vessel comprises xenon at a fill pressure of about 100 to about 1000 torr.

6. In a high pressure sodium vapor discharge lamp according to claim 5, wherein said inert buffer gas within said discharge vessel comprises xenon at a fill pressure of about 100 to about 130 torr.

7. In a high pressure sodium vapor discharge lamp of the type having an elongate discharge vessel, an inert buffer gas within said discharge vessel, and a sodium amalgam within said discharge vessel, the improvement comprising:

a starting aid consisting essentially of a metallic band proximate one end portion of said discharge vessel and disposed on said discharge vessel circumferentially thereof, and the surface of said discharge vessel being free of auxiliary conductors, and means for applying a voltage to said metallic band for inducing ionization throughout the volume of said discharge vessel to facilitate lamp starting.

8. In a high pressure sodium vapor discharge lamp according to claim 7, wherein said metallic band is a heat shield for inhibiting thermal radiation from an end of said discharge vessel.

9. In a high pressure sodium vapor discharge lamp according to claim 8, wherein said means for applying a voltage is comprised of a bimetallic switch responsive to the temperature of said discharge vessel for removing the voltage applied to said heat shield after the temperature of said discharge vessel has reached a certain predetermined temperature.

10. In a high pressure sodium vapor discharge lamp according to claim 9, where said inert buffer gas within said discharge vessel comprises xenon at a fill pressure of about 100 to about 1000 torr.

11. In a high pressure sodium vapor discharge lamp according to claim 10, wherein said inert buffer gas within said discharge vessel comprises xenon at a fill pressure of about 100 to about 130 torr.

12. In a high pressure sodium vapor discharge lamp according to claim 7, wherein said means for applying a voltage is comprised of a bimetallic switch responsive to the temperature of said discharge vessel for removing the voltage applied to said metallic band after the temperature of said discharge vessel has reached a certain predetermined temperature.

13. In a high pressure sodium vapor discharge lamp according to claim 3, where said inert buffer gas within said discharge vessel comprises xenon at a fill pressure of about 100 to about 1000 torr.

14. In a high pressure sodium vapor discharge lamp according to claim 13, wherein said inert buffer gas within said discharge vessel comprises xenon at a fill pressure of about 100 to about 130 torr.

* * * * *